US005990057A

United States Patent [19]

Sharp

[11] Patent Number: 5,990,057

[45] Date of Patent: Nov. 23, 1999

[54] LIQUID FIRE STARTER COMPOSITION

[76] Inventor: Barbara W. Sharp, 3839 Mallard Way, Stevensville, Mont. 59840

[21] Appl. No.: 09/116,423

[22] Filed: Jul. 15, 1998

[51] Int. Cl.[6] ..... C10M 129/06; C10L 11/00

[52] U.S. Cl. ..... 508/583; 44/451

[58] Field of Search ..... 508/583; 44/451

[56] References Cited

U.S. PATENT DOCUMENTS

| | | | |
|---|---|---|---|
| 3,389,088 | 6/1968 | Schar et al. | 508/583 |
| 3,395,003 | 7/1968 | Alexander | 44/520 |
| 3,759,674 | 9/1973 | Gregg | 44/266 |
| 4,084,939 | 4/1978 | Zmoda | 44/266 |
| 4,261,700 | 4/1981 | Monick | 44/266 |
| 4,365,971 | 12/1982 | Monick | 44/266 |
| 4,371,447 | 2/1983 | Webb et al. | 508/583 |
| 4,382,802 | 5/1983 | Beinke et al. | 44/301 |
| 4,436,525 | 3/1984 | Zmoda et al. | 44/266 |
| 4,485,584 | 12/1984 | Raulerson et al. | 44/531 |
| 4,878,922 | 11/1989 | Kaye | 44/502 |
| 5,053,057 | 10/1991 | Schuster | 44/349 |
| 5,720,784 | 2/1998 | Killick et al. | 44/451 |
| 5,883,055 | 3/1999 | Baca | 508/206 |

*Primary Examiner*—Ellen M. McAvoy
*Attorney, Agent, or Firm*—Saliwanchik, Lloyd & Saliwanchik

[57] ABSTRACT

The subject invention pertains to liquid fire starter compositions and methods of making and using the fire starter compositions. The liquid fire starters comprise mineral oil and an alcohol. Mineral oil makes up approximately 80–98% volume to volume (v/v) of the fire starter composition while the alcohol comprises approximately 2–20% (v/v) of the composition. A preferred embodiment comprises about 95% mineral oil and about 5% ethanol. The starter can be shaken, applied to a combustible, then lighted to ignite charcoal or other flammable materials. The fire starter compositions of the invention are odorless and safe for indoor as well as outdoor use.

16 Claims, No Drawings

LIQUID FIRE STARTER COMPOSITION

BACKGROUND OF THE INVENTION

The smell of a charcoal fire summons pleasant memories of summertime, friends and family. The odors and inconvenience associated with starting that fire however are not so pleasant. Currently, charcoal fire starters available to consumers are combustible solutions that include the chemical naphtha. Naphtha is a petroleum by-product. Although naphtha-containing charcoal fire starters are advertized as being odorless, the chemical has a distinct aroma. Charcoal fires started by naphtha products are odorless only after the chemical burns away and the charcoal is ignited. The strong odor of naphtha-containing products make them inconvenient for use indoors. Additionally, naphtha has a flash point of 107° F. The chemical burns very quickly, often too quickly to ignite the coals making it necessary to reapply the starter. Further, the low flash point of the chemical could result in flash-back or flare-up if inadvertently added to burning coals.

Charcoal fire starters that do not contain naphtha have been described. They include gelled alcohols (U.S. Pat. Nos. 3,759,674 and 4,365,971). Gelled alcohols are semi-solid materials of fast burning alcohol that provide a clean, non-sooty flame. Gelled alcohols however sometimes liquify while burning resulting in the starter running off the coals which they are intended to ignite. Additionally, gelled alcohols often burn with non-luminous flames increasing the possibility of injury to the cook. U.S. Pat. Nos. 4,436,525 and 4,084,939 address these problems by providing a solid alcohol gel which retains its shape upon burning and providing an encapsulated gelled alcohol which cracks audibly alerting the cook of a burning flame. Gelled alcohols are advantageous in that they generate less odor than naphtha containing products; however, they do not offer the convenience of a liquid fire starter. U.S. Pat. No. 4,382,802 describes a fire starter which is a liquid and is an oil-in-water emulsion. Other charcoal fire starters that have been described include a solid starter of cellulose materials impregnated by waxes and oils (U.S. Pat. Nos. 4,485,584 and 3,395,003). These materials however leave a residue and ash in the grill from the solid matrix.

As can be understood from the above, there remains a need for a liquid charcoal fire starter that is odorless, easy to use, safe and effective.

SUMMARY OF THE INVENTION

Odorless, safe liquid charcoal fire starters are described. The starters comprises mineral oil and a lower alcohol. In one embodiment, the mineral oil is present in the composition at about 80% to about 98% volume to volume (v/v) and the alcohol is present in the composition from about 20% to about 2% (v/v). In a preferred embodiment, a starter composition comprises 95% mineral oil and 5% ethanol. The starter is odorless and its constituents are safe for handling.

DETAILED DESCRIPTION OF THE SUBJECT INVENTION

The subject invention concerns materials and methods for starting a fire, such as a charcoal fire. The compositions of the subject invention can be used as a liquid charcoal fire starter. The starters comprise mineral oil and alcohol. Mineral oil is about 80–98% volume to volume (v/v) of the composition while alcohol constitutes from about 2–20% (v/v) of the composition. The starters are odorless and safe for indoor as well as outdoor use.

When placed in a container, compositions of the present invention separate into layers, with the mineral oil overlying the alcohol For use, the container is shaken vigorously to mix the layers. The starter is then applied to charcoal or other flammables and lighted immediately. The alcohol burns instantly, thereby igniting the mineral oil. The mineral oil burns strongly and persistently to ignite the charcoal.

The liquid fire starters of the subject invention comprise mineral oil. Mineral oil is a common household product used in cosmetics and as a laxative. Mineral oil, also known as paraffin oil, is stable and non-toxic. Paraffin oil is used as indoor lamp oil. In one embodiment, mineral oil having a viscosity of about 33.5 centistokes at 40° C. or less is used in the compositions of the subject invention. Mineral oil of this viscosity burns readily and overlays the alcohol in the container preventing evaporation of the alcohol during storage.

The mineral oil is ignited by the quick burning alcohol present in the subject composition. Any number of lower alcohols can be used in the compositions of the present invention. Alcohols useful according to the subject invention include but are not limited to methanol, ethanol and isopropanol. In a particularly preferred embodiment, ethanol is incorporated into the composition. Ethanol is preferred for safety reasons. When the composition of the subject invention is prepared with denatured ethanol only about 0.2% is toxic methanol making the composition safe even if consumed accidentally.

Compositions of the subject invention are desirable for use around the home and family because, as noted above, its constituents are safe and non-toxic. The ingestion of excessive amounts of mineral oil will cause only a mild case of diarrhea. While methanol can be poisonous, ethanol is consumed in alcoholic beverages and isopropanol poses only a slight health risk.

The components of the claimed compositions reduce the risk of injury due to flashback or flare-up should the liquid fire starter be inadvertently applied to hot or burning coals. If applied to burning coals, the composition would extinguish the fire or smolder for only a short time. As noted, the alcohol in the composition burns instantly to ignite the mineral oil which in turn ignites the charcoal. The flash point of ethanol is approximately 55° F. Should flare-up occur, the low flash point and small amount of alcohol present assures a short-lived flame. The flash point of about mineral oil is about 420° F. Inadvertent application of mineral oil to burning coals would smother the coals.

The components of the compositions of the subject invention burn clean making the compositions particularly advantageous for indoor use. By-products produced by burning a composition of the subject invention include water vapor, carbon dioxide and small amounts of carbon monoxide. Thus, the by-products from burning the subject composition are similar to those by-products emitted from a burning wax candle. Alcohol is commonly used and burned indoors in lamps, fondue pots and chafing dishes. The minimal odor and safety of the present compositions make them attractive for use in lighting wood-burning stoves and wood -burning fireplaces.

The composition of the subject invention are made by combining the mineral oil and alcohol in a container. A plastic container or bottle is preferred for holding the fire starter compositions. Type 1 or 2 plastic bottles are particularly preferred for storing the compositions. Alcohol is placed in the bottle first and the mineral oil is layered over the alcohol. The composition remains separated in layers until it is shaken for use.

The compositions ofthe subject invention comprise mineral oil and an alcohol. In one embodiment, the composition of the present invention comprises, about 95% (v/v) mineral oil and about 5% (v/v) of a lower alcohol. When used as a fire starter for charcoal, the fast burning alcohol ignites the mineral oil which burns steadily until the charcoal is ignited. There must be sufficient alcohol to ignite the mineral oil. Compositions comprising less than about 20% however are advantageous in that there is less chance of flare-up by the alcohol if the composition is inadvertently applied to hot coals. Thus the composition may have from about 80% to about 98% mineral oil and from about 2% to about 20% alcohol. More preferably, the composition will have from about 90% to about 97% mineral oil and from about 3% to about 10% alcohol. Most preferably, the composition will have about 95% mineral oil and about 5% alcohol.

Further, during storage, the components separate with the mineral oil overlaying the alcohol. Lesser quantities of alcohol assure that the mineral oil adequately covers the alcohol preventing evaporation and dissipation of the constituent. The rate of evaporation of mineral oil is negligible. In a particularly preferred embodiment, it has been found that a mixture of 19 parts mineral oil to one part alcohol burns efficiently and safely. At this amount, there is sufficient alcohol to ignite the mineral oil yet little enough to prevent flare up.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A liquid fire starter composition consisting essentially of mineral oil having a viscosity of 33.5 centistokes at 40° C. or less and at least one lower alcohol, wherein the mineral oil comprises volume to volume from about 80% to about 98% of the composition and the alcohol comprises from about 2% to about 20% of the composition.

2. The composition of claim 1, wherein said mineral oil comprises from about 90% to about 97% of said composition and said alcohol comprises from about 3% to about 10% of said composition.

3. The composition of claim 1, wherein said mineral oil comprises about 95% of said composition and said alcohol comprises about 5% of said composition.

4. The composition of claim 1, wherein said alcohol is selected from the group consisting of methanol, ethanol and isopropanol.

5. The composition of claim 1, wherein said alcohol is ethanol.

6. A method of making a liquid fire starter composition comprising the steps of:

(a) dispensing at least one lower alcohol into a container; and (b) dispensing mineral oil having a viscosity of 33.5 centistokes at 40° C. or less into the container;

wherein the mineral oil comprises volume to volume from about 80% to about 98% of the composition and the alcohol comprises from about 2% to about 20% of the composition.

7. The method of claim 6 wherein said mineral oil comprises from about 90% to about 97% of said composition and said alcohol comprises from about 3% to about 10% of said composition.

8. The method of claim 6, wherein said alcohol comprises about 5% of said composition and said mineral oil comprises about 95% of said composition.

9. The method of claim 6, wherein said alcohol is selected from the group consisting of methanol, ethanol and isopropanol.

10. The method of claim 6, wherein said alcohol is ethanol.

11. A method of starting a fire comprising the steps of:

(a) shaking then applying to a combustible material a liquid fire starter consisting essentially of volume to volume from about 80% to about 98% mineral oil having a viscosity of 33.5 centistokes at 40° C. or less and from about 2% to about 20% lower alcohol; and (b) igniting the fire starter;

wherein said alcohol burns and ignites the mineral oil which burns to ignite the combustible material.

12. The method of claim 11, wherein said mineral oil comprises about 90% to about 97% of said composition and said alcohol comprises from about 3% to about 10% of said composition.

13. The method of claim 11, wherein said mineral oil comprises about 95% of said composition and said alcohol comprises about 5% of said composition.

14. The method of claim 11, wherein said alcohol is selected from the group consisting of methanol, ethanol and isopropanol.

15. The method of claim 11 wherein said alcohol is ethanol.

16. A liquid fire starter composition made according to the method of claim 6.

* * * * *